US008529302B2

(12) United States Patent
Ogura et al.

(10) Patent No.: US 8,529,302 B2
(45) Date of Patent: Sep. 10, 2013

(54) ELECTRICAL CONNECTOR FOR FLAT CONDUCTOR

(75) Inventors: Yoshiyuki Ogura, Kanagawa (JP); Yasuyoshi Yoshikai, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 88 days.

(21) Appl. No.: 13/147,074

(22) PCT Filed: Apr. 23, 2010

(86) PCT No.: PCT/JP2010/057250

§ 371 (c)(1), (2), (4) Date: Dec. 19, 2011

(87) PCT Pub. No.: WO2010/140438

PCT Pub. Date: Dec. 9, 2010

(65) Prior Publication Data

US 2012/0094520 A1 Apr. 19, 2012

(30) Foreign Application Priority Data

Jun. 1, 2009 (JP) ..... 2009-132169

(51) Int. Cl.
*H01R 12/24* (2006.01)

(52) U.S. Cl.
USPC ..... 439/795

(58) Field of Classification Search
USPC ..... 439/495, 492–494, 496–499, 260, 439/345
See application file for complete search history.

(56) References Cited

U.S. PATENT DOCUMENTS

2006/0089036 A1* 4/2006 Takai et al. ..... 439/260

FOREIGN PATENT DOCUMENTS

| | | |
|---|---|---|
| JP | 10-270131 | 10/1998 |
| JP | 2005-078908 | 3/2005 |
| JP | 2008-277068 | 11/2008 |
| JP | 2009-070757 | 4/2009 |

* cited by examiner

*Primary Examiner* — Tulsidas C Patel
*Assistant Examiner* — Phuongchi Nguyen
(74) *Attorney, Agent, or Firm* — Lowe, Hauptman, Ham & Berner, LLP

(57) ABSTRACT

A connector comprising a connector main body for insertion of an object to be connected; a plurality of contacts disposed at intervals from one another within the connector main body in the width direction; and a freely rotatable press member for pressing respective contacts against the inserted object to be connected. When the press member is rotated in one direction, respective contacts are pressed toward the object to be connected by the press member and, when the press member is rotated in the other direction, the press of the respective contacts by the press member is cancelled. A rotation fulcrum of the press member is provided between one and the other ends so that when one end of the press member is pressed, the press member rotates in one direction and, when the other end of the press member is pressed, the press member rotates in the other direction.

14 Claims, 9 Drawing Sheets

ELECTRICAL CONNECTOR FOR FLAT CONDUCTOR

RELATED APPLICATIONS

The present application is based on, and claims priority from, JP Application Number 2009-132169, filed Jun. 1, 2009, and PCT Application Number PCT/JP10/057250, filed Apr. 23, 2010, the contents of which are hereby incorporated by reference herein in their entireties.

TECHNICAL FIELD

The present invention relates to a connector used to connect, for example, a flexible printed circuit (FPC) or a flexible flat cable (FFC).

BACKGROUND ART

As this type of connector, there has conventionally been known a connector provided with a connector main body into the front side of which one end of an object to be connected (hereinafter referred to as a flexible circuit), such as an FPC or an FFC, can be inserted, a plurality of contacts disposed in the connector main body in the width direction thereof, and a freely rotatable press member for pressing the flexible circuit inserted into the connector main body toward respective contacts (see, for example, Patent Literature 1).

This connector is adapted so that when the press member is rotated in one direction with the flexible circuit inserted into the connector main body, the flexible circuit and the respective contacts are brought into pressure contact and electrical conduction with each other by the press member and, when the press member is rotated in the other direction, pressure contact between the respective contacts and the flexible circuit is cancelled, thereby enabling the flexible circuit to be inserted/removed into/from the connector main body.

Patent Document 1: Japanese Patent Publication 2005-78908

SUMMARY OF INVENTION

Problem to be Solved by the Invention

Incidentally, in the above-described connector, a rotation fulcrum is provided at one end of the press member. When the other end of the press member is pressed in one direction to rotate the press member, respective contacts are pressed toward the flexible circuit. Accordingly, the other end of the press member needs to be pulled upwardly with fingertips when rotating the press member in the other direction. However, if, for example, the connector is mounted on a board, only a small space to insert fingertips into is available between the other end of the press member and the board. Thus, the connector has been problematic in that the press member cannot be operated easily. The connector has also been problematic in that if a space between the other end of the press member and the board is made larger, the connector itself increases in size in the height direction thereof, thus being disadvantageous in mounting on small-sized electronic equipment.

The present invention has been accomplished in view of the above-described problems, and an object of the invention is to provide a connector in which the operability of the press member can be improved without increasing the size of the connector itself in the height direction thereof.

Means for Solving the Problem

In order to achieve the aforementioned object, a connector of the present invention is provided with a connector main body into which an object to be connected is inserted, a plurality of contacts disposed at intervals from one another within the connector main body in the width direction thereof, and a freely rotatable press member for pressing respective contacts against the object to be connected inserted into the connector main body, so that when the press member is rotated in one direction, respective contacts are pressed toward the object to be connected by the press member and, when the press member is rotated in the other direction, the press of the respective contacts by the press member is cancelled, wherein rotation fulcrums of the press member are provided between one and the other ends thereof, so that when one end of the press member is pressed, the press member rotates in one direction and, when the other end of the press member is pressed, the press member rotates in the other direction.

Consequently, when one end of the press member is pressed to rotate the press member in one direction, the respective contacts are pressed toward the object to be connected by the press member and, when the other end of the press member is pressed to rotate the press member in the other direction, the press of the respective contacts by the press member is cancelled. Thus, the press member can be rotated by press operation in whichever direction the press member is rotated.

Advantageous Effects of Invention

According to the present invention, the press member can be rotated by press operation in whichever direction the press member is rotated. Thus, it is possible to improve the operability of the press member. In this case, the press member need not be pulled up with fingertips as is done conventionally. Accordingly, there is no need to increase the size of the connector itself in the height direction thereof, in an attempt to improve the operability. Thus, the connector is extremely advantageous in mounting on small-sized electronic equipment.

BEST MODE FOR CARRYING OUT THE INVENTION

Figure 1:
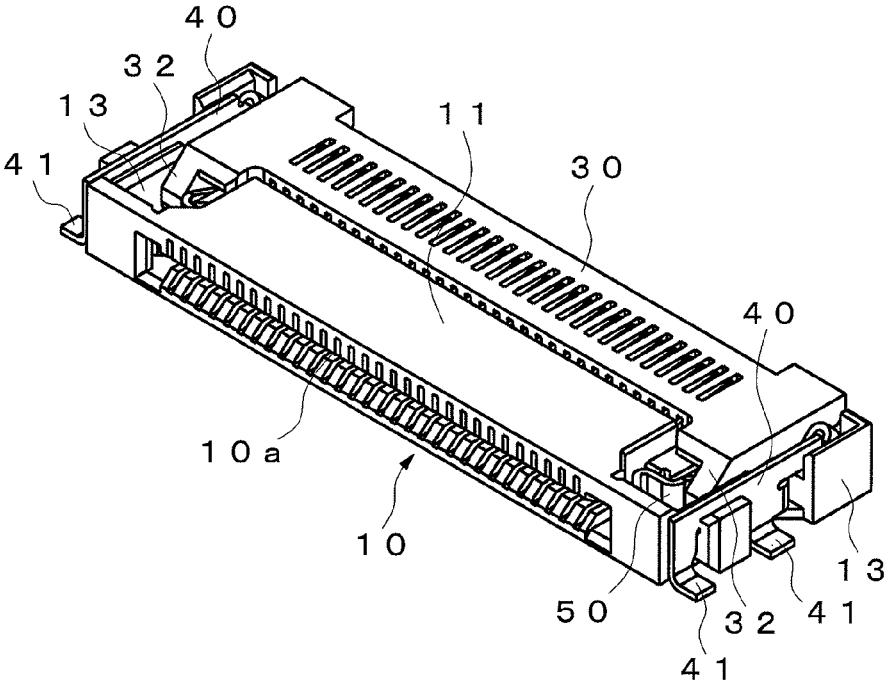
FIG. 1 is a front side perspective view of a closed state connector showing first embodiment of this invention.
Figure 2:
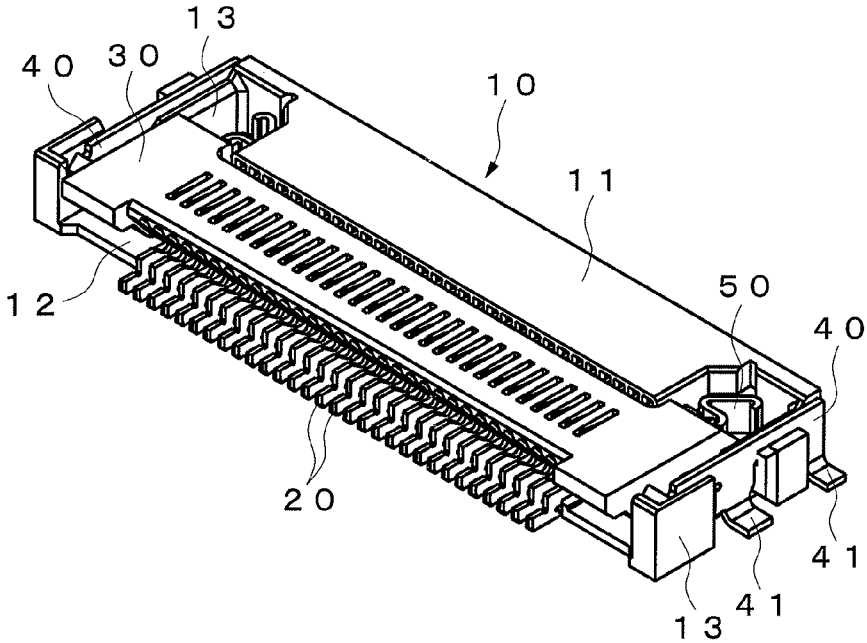
FIG. 2 is rear side perspective view of the closed state connector.
Figure 3:
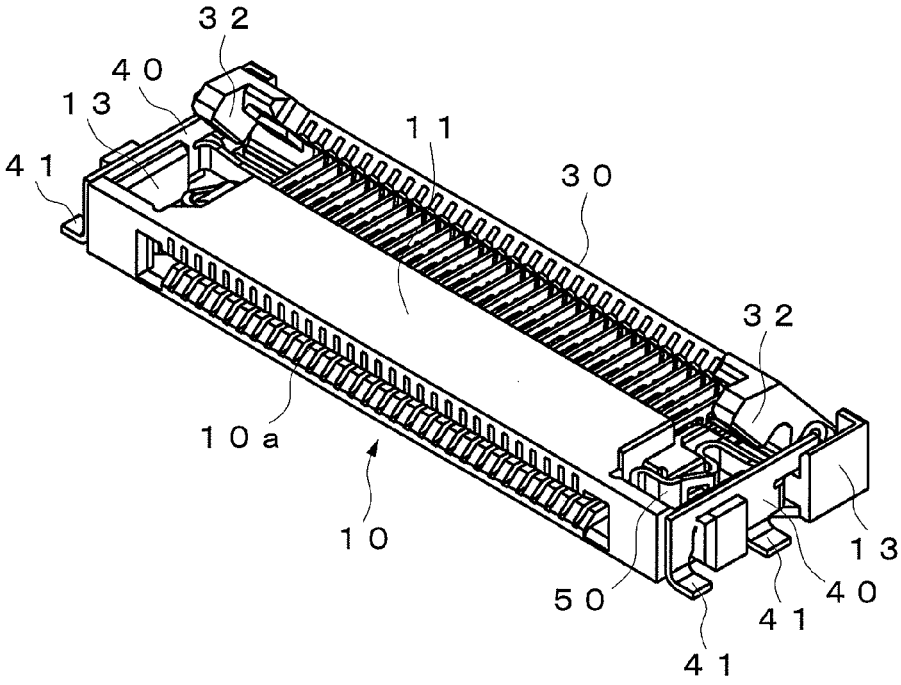
FIG. 3 is a front side perspective view of an opened state connector.
Figure 4:
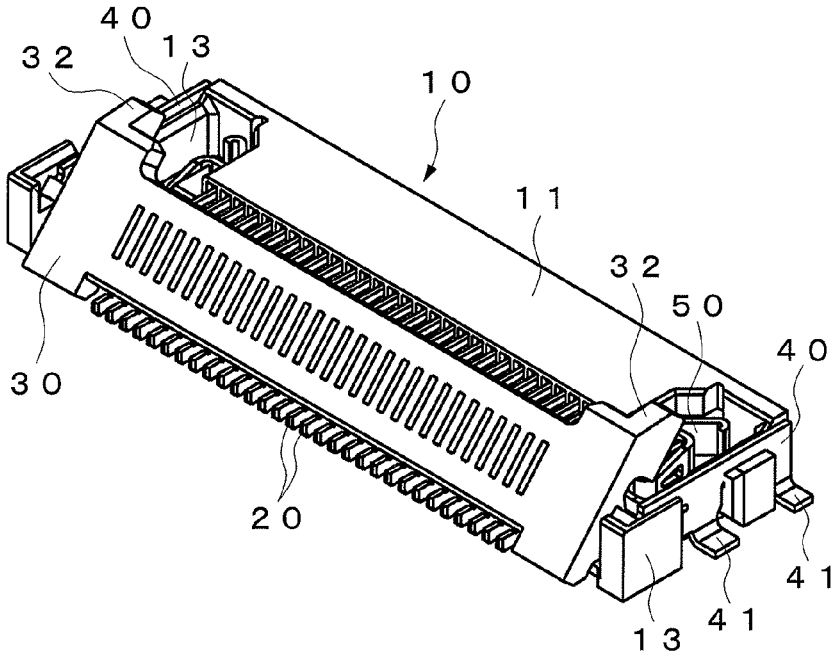
FIG. 4 is a rear side perspective view of the opened state connector.

FIG. 1 through 11 show a first embodiment of the present invention. A connector shown in said FIGS. comprises a connector main body 10 into which a flexible circuit 1 to be inserted as an object to be connected, a plurality of contacts 20 arranged with spaces in the width direction of the connector main body 10, a press member 30 capable of rotating for pushing each contacts toward the flexible circuit 1 side which is inserted into the connector main body 10, a pair of left/right fixing members 40 for fixing the connector main body 10 to a circuit board which is not shown in any of FIGS., and a pair of left/right lock members 50 with which the flexible circuit 1 is engaged.

The flexible circuit 1 is configured of what is called a flexible flat cable (FFC) or a flexible printed circuit (FPC), a plurality of electrical metal terminals (not shown) is provided at an upper face of a tip side of the flexible circuit 1 with spaces in the width direction. Also, dented portions la as the engagement portion for being engaged with the lock members 50 is provided at both end sides in the width direction of the flexible circuit 1. When the flexible circuit 1 is inserted into a predetermined position of the connector main body 10 (position for connecting with the contacts 20), each of the lock members 50 is engaged with the dented portions respectively.

The connector main body 10 is made of a synthetic resin molding, and an insertion slot 10*a* for inserting the flexible circuit 1 is provided at a front face of the connector main body 10. The connector main body 10 comprises an upper face portion 11, a bottom face portion 12, and left and right side face portions 13, the upper face portion 11 is configured only at the front end side of the upper face of the connector main body 10. Also, both of the left and right sides of the upper face portion 11 are opened to expose the inside of the connector main body 10, and the lock members 50 are disposed at the exposed portions.

Each of the contacts 20 is made of a conductive metal plate which is arranged at the bottom face portion 12 of the connector main body 10 with spaces in the width direction. Each of the contacts 20 comprises a fixing piece portion 21 for fixing with the bottom face portion 12, a first movable piece portion 22 pushed by the press member 30, a second movable piece portion 23 arranged at the lower side of the first movable piece portion 22, and a springy piece portion 24 formed between the second movable portion 23 and the fixing piece portion 21.

The fixing piece portion 21 extends in the front-rear direction of the connector main body 10, a front end portion 21*a* thereof is pushed into a slit at the bottom face portion 12 side. A connecting portion 21*b* for connecting to a circuit board, which is not shown in any of FIGS., is provided at the rear end of the fixing piece portion 21, the connecting portion 21*b* extends toward backward of the connector main body 10. A first convex portion 21*c* capable of rotatably engaging with the press member 30 is provided at the rear end side of the fixing piece portion 21, and a first concave portion 21*d* is provided at the front side of the first convex portion 21*c*.

The first movable piece portion 22 extends in the vertical direction of the connector main body 10, a first contacting portion 22*a* for contacting the upper face of the flexible circuit 1 is provided so as to protrude downwardly at the front end of the movable piece portion 22. A first abutting portion 22*b* and a second abutting portion 22*c* for abutting against the press member 30 are provided at the rear end of the first movable piece portion 22, the first contacting portion 22*b* is provided at the rear end side of the first movable piece portion 22 downwardly inclining from upper side to the lower side, the second abutting portion 22*c* is formed approximately horizontally in the front-rear direction at the bottom end face of the first movable piece portion 22.

The second movable piece portion 23 extends toward the front-rear direction of the connector main body 10, a second contacting portion 23*a* for contacting the upper side of the flexible circuit 1 is provided to protrude downwardly at the front end of the second movable piece portion 23. In this embodiment, the second movable piece portion 23 is shorter than the first movable piece portion 22 in the front-rear direction of the connector main body 10, and the width of the second movable piece portion 23 is smaller in the front-rear direction than the width of the first movable piece portion 22. Also, the second contacting portion 23*a* is placed at the rear side of the first contacting portion 22*a*, the lower end of the second contacting portion 23*a* is the same height as the lower end of the first contacting portion 22*a* (contacting point). The rear end side of the second movable piece portion 23 bends upwardly and extends toward the rear end side of the first movable piece portion 22 (ahead of the second abutting portion 22*c*), the first movable piece portion 22 is supported by the rear end side of the second movable piece portion 23.

The springy piece portion 24 extends in the vertical direction from an approximate center in the front-rear direction of the fixing piece portion 21 to an approximate center in the front-rear direction of the second movable piece portion 23, the first movable piece portion 22 and the second movable piece portion 23 are respectively supported so that the front end sides and rear end sides of the first movable piece portion 22 and the second movable piece portion 23 are respectively movably in the vertical direction.

The press member 30 is made of a synthetic resin molding the press member 30 covers the upper face in the rear end side of the connector main body 10. A rotation support portion 31 protruding toward the inside of the connector main body 10 is provided at the rear end side of the press member 30. A second convex portion 31*a* for engaging with the first concave portion 21*c* of the contacts 20 is provided at the tip of the rotation support portion 31. A second convex portion 31*b* for engaging with the first concave portion 21*d* of the contacts 20 is provided at the front part of the second concave portion 31*a*. In other words, the press member 30 rotates on a fulcrum where the second concave portion 31*a* contacts the first convex portion 21*c* by engaging the second concave portion 31*a* with the first convex portion 21*c*, and the press member 30 rotates on a fulcrum where the second convex portion 31*b* is contacted with the first concave portion 21*d* by engaging the second convex portion 31*b* with the first concave portion 21*d*. In this embodiment, the fulcrum is located between the front end side and the rear end side of the press member 30, when the front end side of the press member 30 is pushed downwardly, the rear end side thereof moves upwardly and locks the press member 30, and when the rear end side of the press member 30 is pushed downwardly, the front end side thereof moves upwardly and releases the press member 30. Also, a press portion 31*c* for abutting against the first abutting portion 22*b* and the second abutting portion 22*c* of the contacts 20 is provided at the rotation support portion 31, the press portion 31*c* protrude in a chevron shape. Protruding portions 32 for regulating the lock members 50 from moving in the width direction are provided at both end sides in the width direction of the press member 30, and each of the protruding portions 32 protrude downwardly.

The fixing members 40 are made of a metal plate arranged at the both end sides in the width direction of the connector main body 10, each of the fixing members 40 are fixed to the both side face portions 13 of the connector main body 10. Connecting portions 41 which connect to a circuit board, which is not shown, are provided at the bottom end side of the fixing member 40, each of the connecting portions 41 extend outside in the width direction of the connector main body 10.

Each of the lock members 50 are made of a metal plate integrally formed with the fixing members 40, each of the lock members 50 is arranged at both ends side in the width direction of the connector main body 10. The lock members 50 comprise an engagement portion 51 for being engaged with the dented portion la of the flexible circuit 1, a movable portion 52 extending backwardly from the engagement portion 51, and a springy portion 53 extending to the fixing members 40 from the rear end of the movable portion 53. The engagement portion 51 and the movable portion 52 move toward the width direction of the connector main body 10 by the springy portion 53 deforming springy. Compared to the movable portion 52, the engagement portion 51 is formed in a chevron shape so as to protrude toward inside in the width direction of the connector main body 10, the movable portion 52 extends straight in the front-rear direction of the connector main body 10. The springy portion 53 extends toward the inside in the width direction of the connector main body 10 from the rear end of the movable portion 52, and the springy portion 53 is bent to extend toward the outside in the width direction of the connector main body 10 to the fixing members 40, the engagement portion 51 and the movable portion 52 move in the width direction of the connector main body 10 by deforming the springy portion 53 springy toward the front-rear direction of the connector main body 10. In this embodiment, when the springy portion 53 is not deformed, a slit into which the protruding portion 32 of the press member 30 can be inserted is provided between the movable portion 52 and the side face portion 13 of the connector main body 10, and when the movable portion 52 is moved toward the outside in the width direction of the connector main body 10, the protruding portion 32 abuts against the movable portion 52 so that the protruding portion 32 is regulated from being inserted in the slit.

Figure 5A:
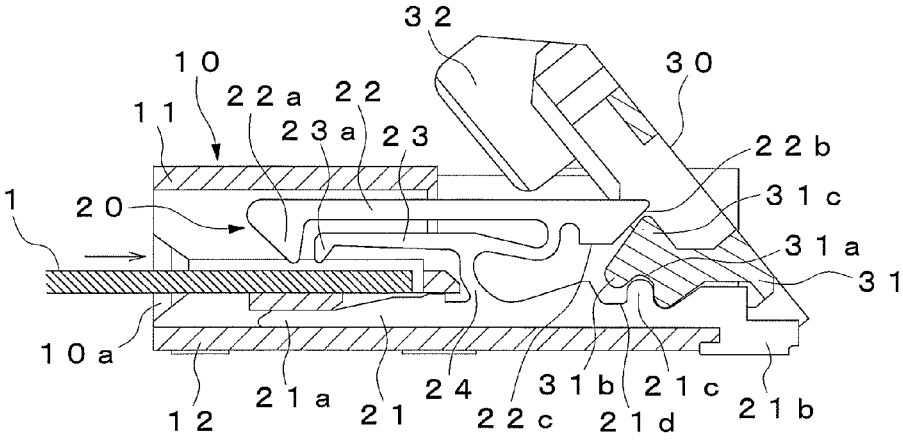
FIG. 5A is a side sectional view showing a closing operation of the connector.
Figure 5B:
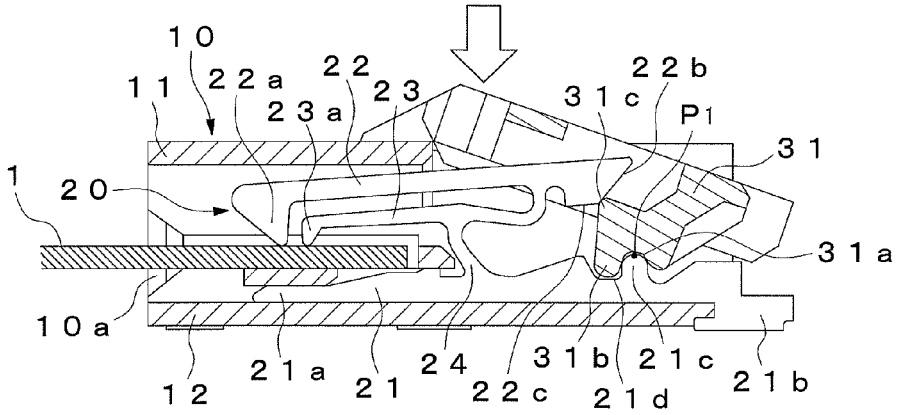
FIG. 5B is a side sectional view showing the closing operation of the connector.
Figure 5C:
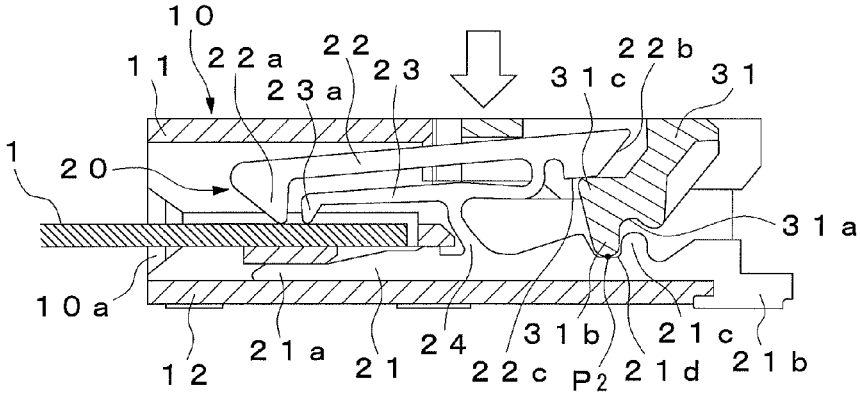
FIG. 5C is a side sectional view showing the closing operation of the connector.

For the above configured connector, as shown in FIG. 5A, while the press member 30 is released, the flexible circuit 1 is inserted into a predetermined position in the connector main body 10 from the insertion slot 10*a*, as shown in FIG. 5B, when the front end side of the press member 30 is pushed downwardly, while the second concave portion 31*a* of the press member 30 is engaged with the first convex portion 21*c*, the press member 30 rotates on a place where the second concave portion 31*a* contacts with the first convex portion 21*c* as a first rotation fulcrum P1, the press portion 31*c* of the press member 30 abuts with the first abutting portion 22*b* of the first movable piece portion 22 toward the front direction. At that time, the first abutting portion 22*b* inclines downwardly toward the front direction, thus, the rear end side of the first movable piece portion 22 is pushed upwardly and the front end side thereof is inclined due to the press portion 31*c*, and, in accordance with this, the rear end side of the second movable piece portion 23 is pushed upwardly and the front end side thereof is inclined. By this, the first contacting portion 22*a* and the second contacting portion 23*a* touch tightly the upper face of the flexible circuit 1, and each of the movable piece portions 22 and 23 is electrically connected to the flexible circuit 1. Next, as shown in FIG. 5C, when the front end side of the press member 30 is pushed further downwardly, the second convex portion 31*b* is engaged with the first concave portion 21*d*, the second concave portion 31*a* is detached from the first convex portion 21*c*, the press member 30 rotates on a place where the second convex portion 31*b* contacts with the first concave portion 21*d* as a second rotation fulcrum P2. By this, the rotation fulcrum of the press member 30 is shifted to the second rotation fulcrum P2 which is further from the press portion 31*c* than the first rotation fulcrum P1, thus, a press force of the press member 30 becomes larger, and the rear end side of the first movable piece portion 22 is pushed further upwardly. At this time, since an abutting position of the press portion 31*c* is shifted to the second abutting portion 22*c*, which is approximately horizontal from the first abutting portion 22*b*, by an abutting of the press portion 31*c* and the second contacting portion 22*c*, each of the movable piece portions 22 and 23 is held as being deformed, and the rotation of the press member 30 toward an opening direction is regulated. Also, due to a change in angles of each of the contacting portions 22*b* and 22*c*, it is possible to feel that the press member 30 is closed when the contacting position of the press portion 31*c* is shifted.

Figure 6A:
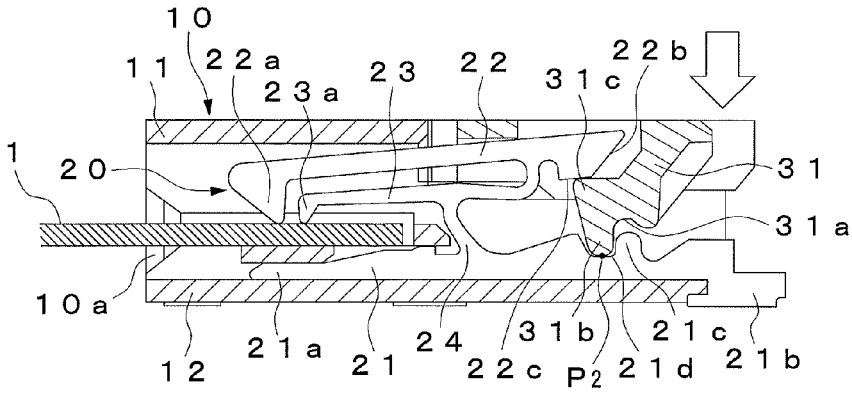
FIG. 6A is a side sectional view showing the opening operation of the connector.
Figure 6B:
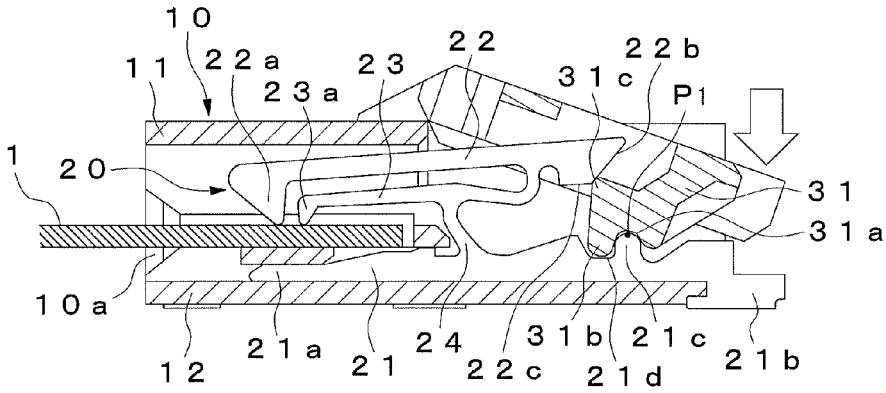
FIG. 6B is a side sectional view showing the opening operation of the connector.
Figure 6C:
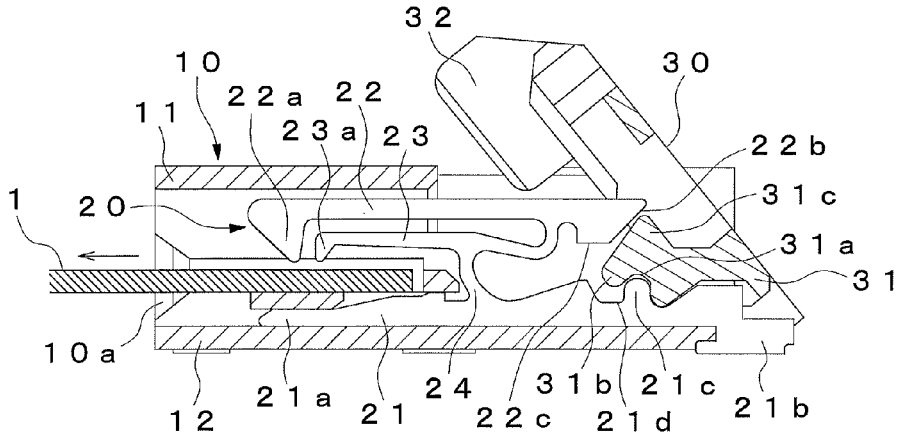
FIG. 6C is a side sectional view showing the opening operation of the connector.

Next, as shown in FIG. 6A, when the rear end side of the press member 30 is pushed downwardly, the second convex portion 31*a* of the press member 30 is engaged with the first convex portion 21*c* as shown in FIG. 6B, the press member 30 rotates on the first rotation fulcrum P1, the front end side of the press member 30 moves upwardly. At this time, the abutting position of the press portion 31*c* is shifted to the first abutting portion 22*b* from the second abutting portion 22*c*. Moreover, when the rear end side of the press member 30 is pushed further downwardly, the pushing member 30 rotates toward the opening direction as shown in FIG. 6C, and the abutting between the press portion 31*c* and the first abutting portion 22*b* is released. By this, the front end portions of the movable piece portions 22 and 23 are moved upwardly by a restoration force of the springy piece portion 24, the contacting portions 22*a* and 23*a* are detached from the flexible circuit 1 and each of the contacts is released, and the flexible circuit 1 can be extracted from the connector main body 10.

Figure 7A:
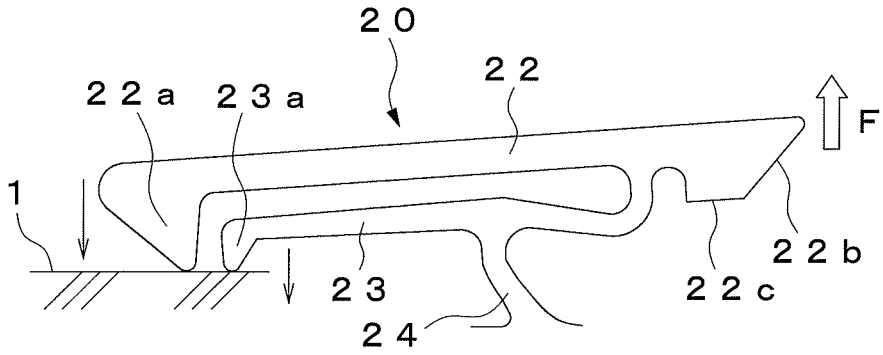
FIG. 7A is an explanatory view of an operation of a contact.
Figure 7B:
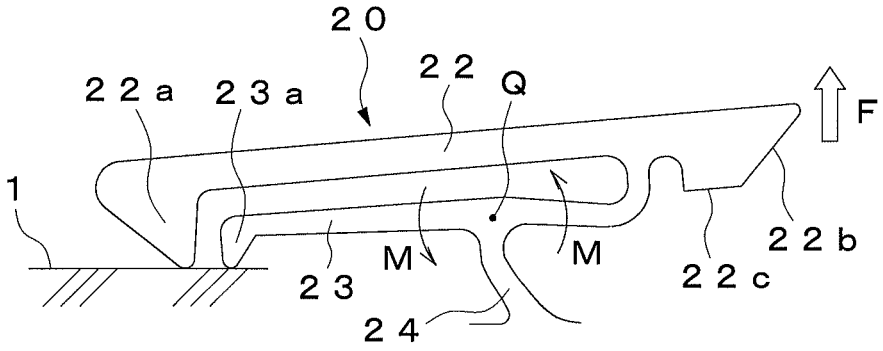
FIG. 7B is an explanatory view of an operation of the contact.

Operations of the contacts 20 when the press member 30 is closed is further explained, as shown in FIG. 7A, when an upward directed force F toward upwards is generated at the rear end side of the first movable piece portion 22, the first contacting portion 22*a* and the second contacting portion 23*a* are pressed to the upper face of the flexible circuit 1. After that, as shown in FIG. 7B, when a further upward directed force F is generated, the rear end side of the second movable piece portion 23 is moved up by the first movable piece portion 22, and a moment M around a fulcrum Q of the springy piece portion 24 as a center thereof is generated. By this, even after the contacting portions 22*a* and 23*a* are touched tightly the flexible circuit 1 respectively, a downward directed pressing force to the front end side of the second movable piece portion 23 increases, and a contact pressure of the second contacting portion 23*a* becomes higher.

Figure 8:
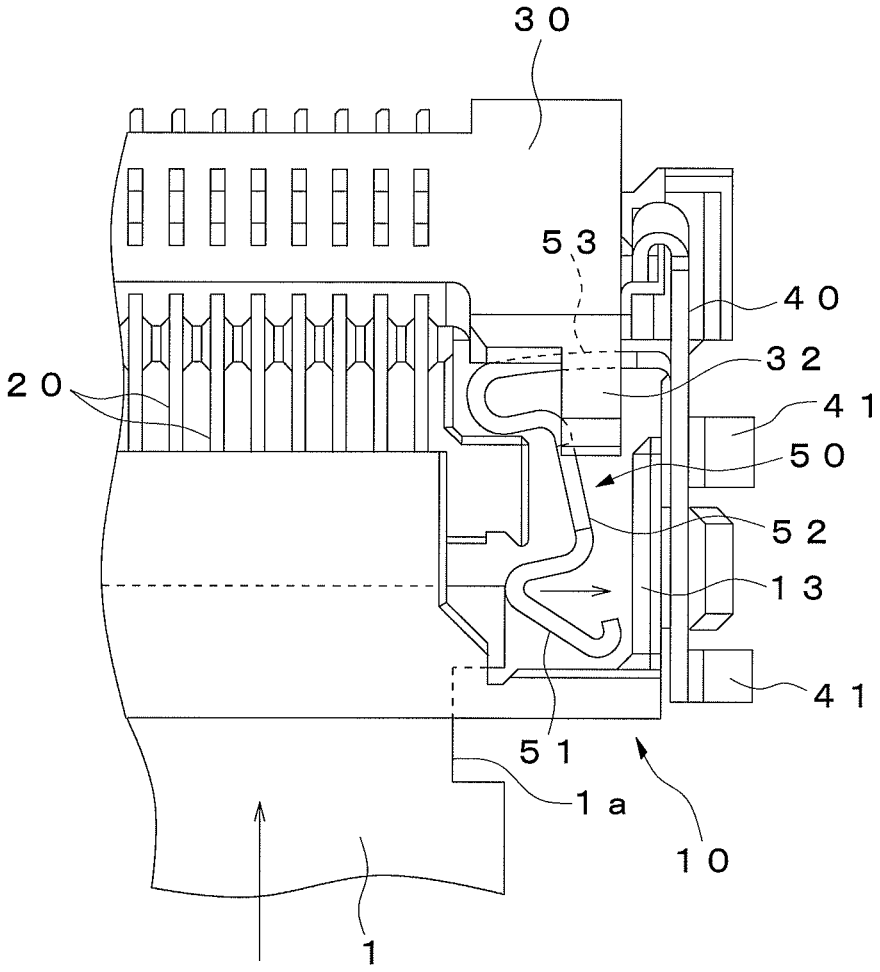
FIG. 8 is a partial plan view of the connector showing an operation of a lock member.
Figure 9:
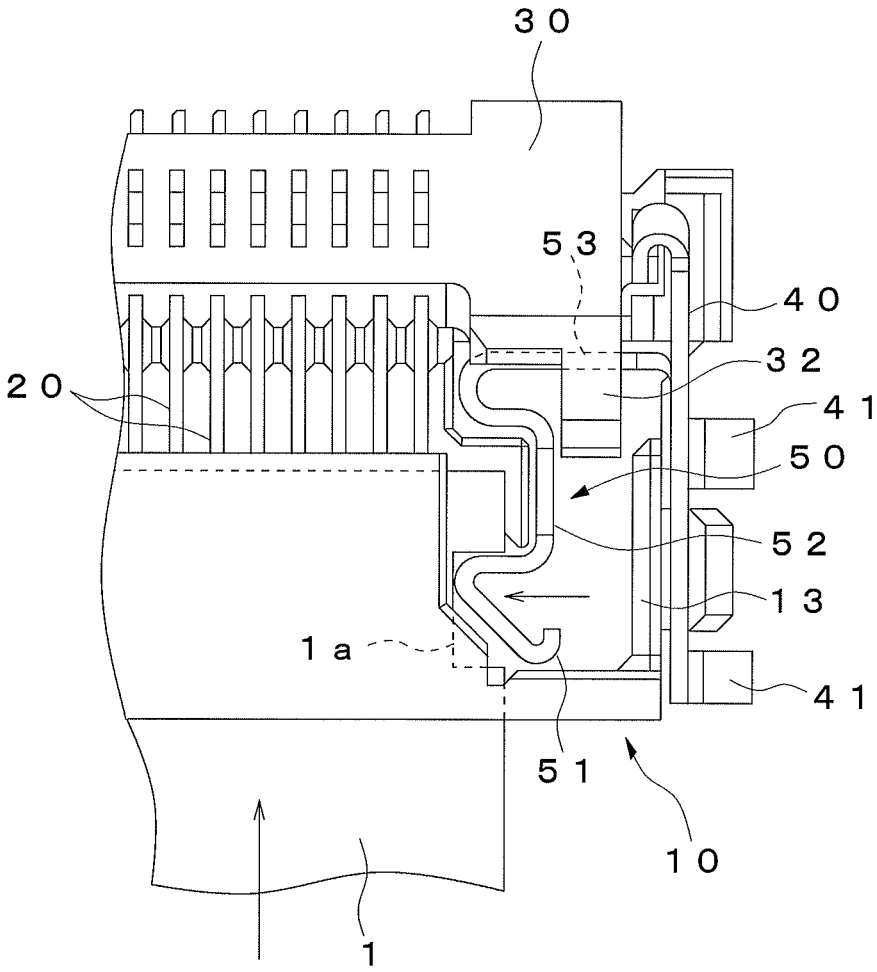
FIG. 9 is a partial plan view of the connector showing an operation of the lock member.
Figure 10:
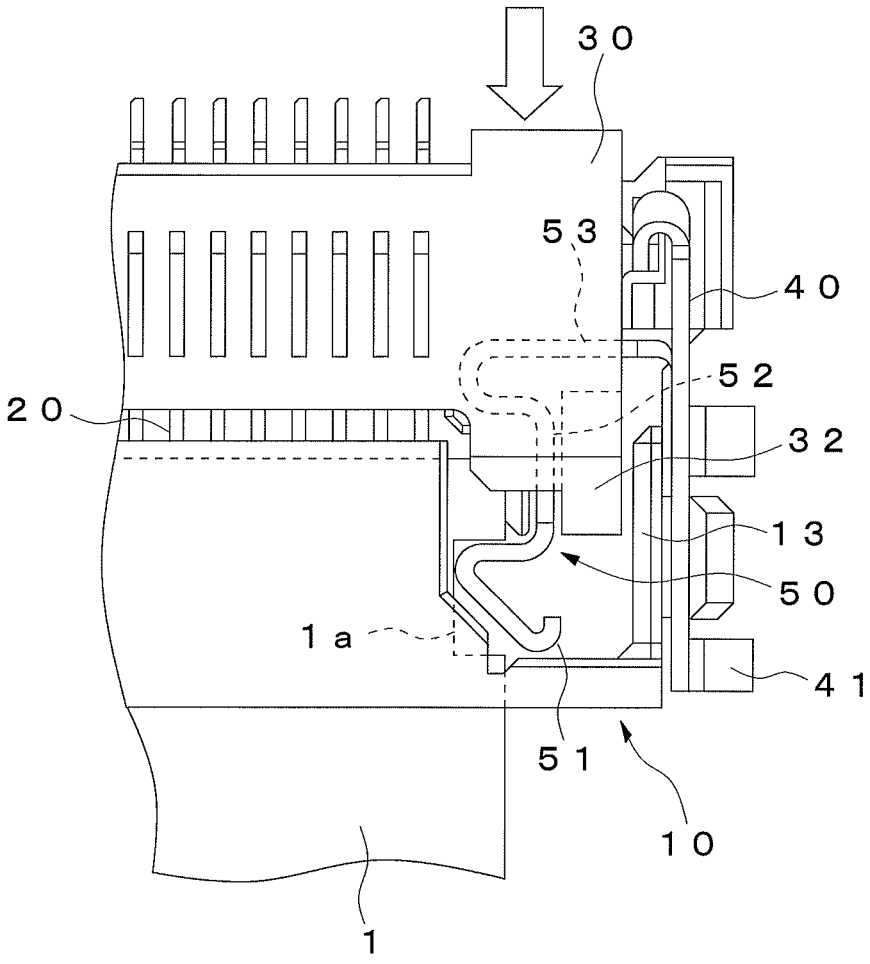
FIG. 10 is a partial plan view of the connector showing an operation of the lock member.
Figure 11:
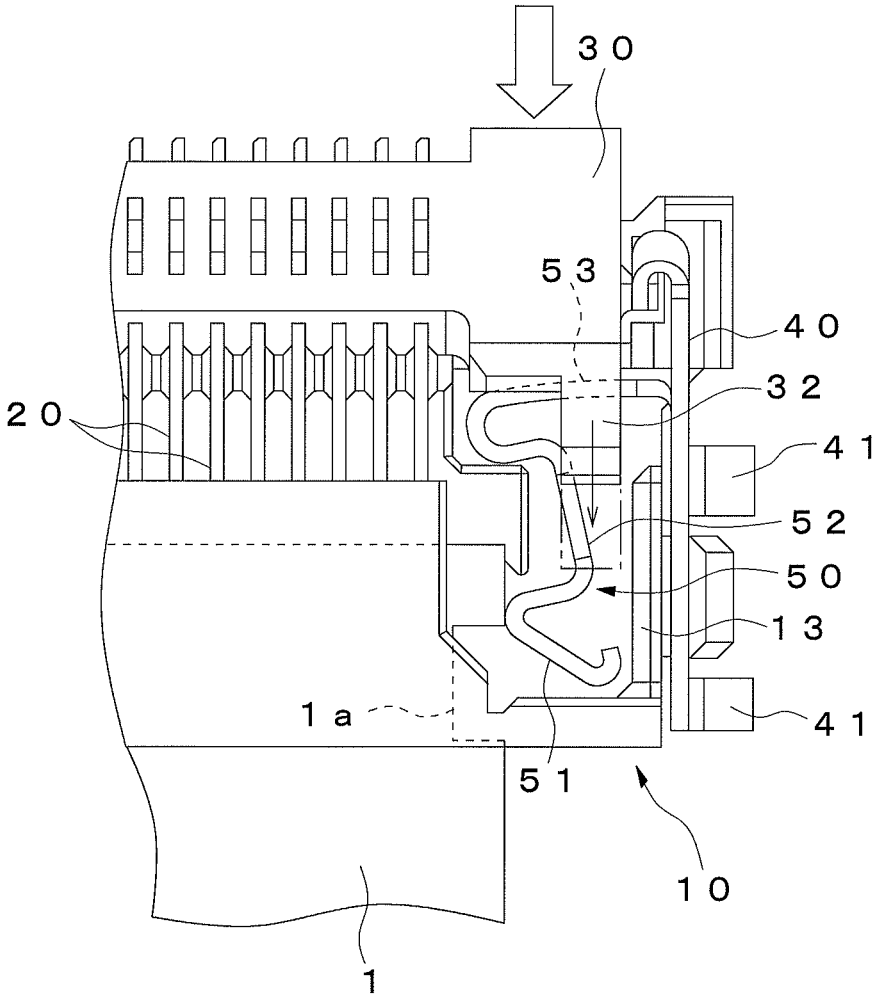
FIG. 11 is a partial plan view of the connector showing an operation of the lock member.

Also, when the flexible circuit 1 is inserted into the insertion slot 10*a* of the connector main body 10, the tip of the flexible circuit 1 abuts against the inclined face of the engagement portion 51 of the lock members 50, as shown in FIG. 8, the engagement portion 51 and movable portion 52 are moved toward outside in the width direction of the connector main body 10. Further, when the flexible circuit 1 is inserted into a predetermined position, as shown in FIG. 9, the engagement portion 51 is engaged with the dented portion 1*a* of the flexible circuit 1, and the engagement portion 51 and the movable portion 52 are moved toward inside in the width direction. By this, the connector main body 10 temporarily holds the flexible circuit 1 by the lock members 50. Next, when the press member 30 is rotated to the closed position, as shown in FIG. 10, the protrude portion 32 of the press member 30 is inserted between the movable portion 52 and the side face portion 13 of the connector main body 10. By this, a movement of the lock members 50 toward outside in the width direction of the lock member 50 is regulated by the protrude portion 32, the flexible circuit 1 becomes completely locked by the lock members 50. As is shown in FIG. 11, when the engagement portion 51 is not engaged with the dented portion la of the flexible circuit 1 because of an imperfect insertion of the flexible circuit 1, the press member 30 is rotated to the closed direction while the engagement portion 51 and the movable portion 52 are moved toward the outside in the width direction of the connector main body 10, the protrude portion 32 of the press member 30 abuts the movable portion 52, and the rotation of the press member 30 to the closed direction becomes regulated. This prevents the press member 30 from being rotated to the closed position when the flexible circuit 1 is imperfectly inserted.

As described above, according to the connector of the present embodiment, rotation fulcrums P1 and P2 of the press member 30 are provided between the anterior and posterior ends thereof, so that when the anterior end of the press member 30 is pressed to rotate the press member 30 in one direction, respective contacts 20 are pressed against the flexible circuit 1 by the press member 30 and, when the posterior end of the press member 30 is pressed to rotate the press member 30 in the other direction, the press of the respective contacts 20 by the press member 30 is cancelled. Thus, the press member 30 can be rotated by press operation in whichever direction the press member 30 is rotated. Consequently, it is possible to improve the operability of the press member 30. In this case, the press member need not be pulled up with fingertips as is done conventionally. Accordingly, there is no need to increase the size of the connector itself in the height direction thereof, in an attempt to improve the operability. Thus, the connector is extremely advantageous in mounting on small-sized electronic equipment.

In addition, the rotation fulcrum of the press member 30 shifts from the first rotation fulcrum P1 to the second rotation fulcrum P2 in the course of the press member 30 being rotated to one rotational position. Since the second rotation fulcrum P2 is provided in a position where a pressing force exerted upon the contacts 20 by the press member 30 is greater than in the position of the first rotation fulcrum P1, the posterior end of a first movable piece portion 22 can be pushed up further at the time of rotating the press member 30 to a closed position. Thus, it is possible to more securely connect the flexible circuit 1 and the respective contacts 20.

Furthermore, the abutting position of the press member 30 shifts from a first abutting portion 22*b* of the contacts 20 to a second abutting portion 22*c* thereof in the course of the press member 30 being rotated to one rotational position. In addition, the respective movable piece portions 22 and 23 of the contacts 20 are displaced by the abutment of the first abutting portion 22*b* and the press member 30, and the respective movable piece portions 22 and 23 are kept displaced by the abutment of the second abutting portion 22*c* and the press member 30. Thus, the press member 30 can be prevented from rotating in an opening direction by the abutment of the press member 30 and the second abutting portion 22*c*. Consequently, it is possible to securely maintain the closed state of the press member 30. At that time, a sense of operation that the press member 30 has been closed can be gained when the abutting position of the press member 30 shifts due to the angular changes of the respective abutting portions 22*b* and 22*c*. Consequently, it is possible to confirm by the sense of operation that the press member 30 has been securely closed.

Yet furthermore, the first convex portion 21*c* and the first concave portion 21*d* with which the press member 30 rotatably engages are provided in the fixing piece portion 21 of the contacts 20. Consequently, it is possible to securely maintain the relative positions of the contacts 20 and the press member 30. Thus, the respective movable piece portions 22 and 23 of the contacts 20 can be precisely operated by the press member 30.

REFERENCE SIGNS LIST

1 . . . Flexible circuit 1,
1*a* . . . Dented portion,
20 . . . Contact,
21 . . . Fixing piece portion,
21*c* . . . First convex portion,
21*d* . . . First concave portion,
22 . . . First movable piece portion,
22*a* . . . First contacting portion,
22*b* . . . First abutting portion,
22*c* . . . Second abutting portion,
23 . . . First movable piece portion,
23*a* . . . Second contacting portion,
24 . . . Springy piece portion,
40 . . . Fixing member,
50 . . . Lock member.

The invention claimed is:

1. A connector comprising a connector main body configured to receive into which an object to be connected is inserted; a plurality of contacts disposed at intervals from one another within the connector main body in the width direction thereof, each contact of the plurality of contacts has a corresponding fixing piece; and a freely rotatable press member for pressing respective contacts against the object to be connected inserted into the connector main body, so that when the press member is rotated in one direction, respective contacts are configured to be pressed toward the object to be connected by the press member and, when the press member is rotated in the other direction, the press of the respective contacts by the press member is configured to be cancelled, wherein a rotation fulcrum of the press member is provided between one and the other ends thereof, so that when one end of the press member is pressed, the press member is configured to rotate rotates in one direction and, when the other end of the press member is pressed, the press member is configured to rotate rotates in the other direction, wherein the rotation fulcrum comprises at least one of a concave portion of the press member configured to engage with a convex portion of the corresponding fixing piece, or a convex portion of the press member configured to engage with a concave portion of the corresponding fixing piece.

2. The connector according to claim 1, wherein the press member is adapted so that the rotation fulcrum thereof shifts from a first rotation fulcrum to a second rotation fulcrum in the course of the press member being rotated to one rotational position, and the second rotation fulcrum is provided in a position where a pressing force exerted upon the respective contacts by the press member is greater than in the position of the first rotation fulcrum.

3. The connector according to claim 1, wherein the contacts are provided with first and second abutting portions against which the press member abuts, and the press member and the contacts are adapted so that the abutting position of the press member shifts from the first abutting portion to the second abutting portion in the course of the press member being rotated to one rotational position, the first abutting portion being formed so that the contacts are displaced by the abutment of the press member, the second abutting portion being formed so that the contacts are kept displaced by the abutment of the press member.

4. The connector according to claim 1, wherein the contacts are provided with an engagement portion with which the press member rotatably engages.

5. The connector according to claim 2, wherein the contacts are provided with an engagement portion with which the press member rotatably engages, the engagement portion includes a first convex portion and a first concave portion provided in the contacts and a second concave portion and a second convex portion provided in the press member, so that the press member rotates with a contacting portion of the first convex portion and the second concave portion as the first rotation fulcrum as the result of the first convex portion and the second concave portion engaging with each other, and that the press member rotates with a contacting portion of the first concave portion and the second convex portion as the second rotation fulcrum as the result of the first concave portion and the second convex portion engaging with each other.

6. A connector comprising:

a connector main body configured to receive an object to be connected;

a plurality of contacts disposed at intervals from one another within the connector main body in the width direction thereof, each contact of the plurality of contacts has a corresponding fixing piece;

a freely rotatable press member for pressing respective contacts against the object to be connected inserted into the connector main body, so that when the press member is rotated in one direction, respective contacts are configured to be pressed toward the object to be connected by the press member and, when the press member is rotated in the other direction, the press of the respective contacts by the press member is configured to be cancelled; and a rotation fulcrum of the press member is provided between one and the other ends thereof, so that when one end of the press member is pressed, the press member is configured to rotate in one direction and, when the other end of the press member is pressed, the press member is configured to rotate in the other direction, wherein the contacts are provided with first and second abutting portions against which the press member abuts, and the press member and the contacts are adapted so that the abutting position of the press member shifts from the first abutting portion to the second abutting portion in the course of the press member being rotated to one rotational position, the first abutting portion being formed so that the contacts are displaced by the abutment of the press member, the second abutting portion being formed so that the contacts are kept displaced by the abutment of the press member, a concave portion of the press member configured to engage with a convex portion of the corresponding fixing piece, or a convex portion of the press member configured to engage with a concave portion of the corresponding fixing piece.

7. The connector according to claim 6, wherein the contacts are provided with an engagement portion with which the press member rotatably engages.

8. The connector according to claim 6, wherein the rotation fulcrum comprises at least one of a concave portion of the press member configured to engage with a convex portion of a fixing piece, or a convex portion of the press member configured to engage with a concave portion of the fixing piece.

9. The connector according to claim 6, wherein the press member is adapted so that the rotation fulcrum thereof shifts from a first rotation fulcrum to a second rotation fulcrum in the course of the press member being rotated to one rotational position, and the second rotation fulcrum is provided in a position where a pressing force exerted upon the respective contacts by the press member is greater than in the position of the first rotation fulcrum.

10. The connector according to claim 9, wherein the contacts are provided with an engagement portion with which the press member rotatably engages, the engagement portion includes a first convex portion and a first concave portion provided in the contacts and a second concave portion and a second convex portion provided in the press member, so that the press member rotates with a contacting portion of the first convex portion and the second concave portion as the first rotation fulcrum as the result of the first convex portion and the second concave portion engaging with each other, and that the press member rotates with a contacting portion of the first concave portion and the second convex portion as the second rotation fulcrum as the result of the first concave portion and the second convex portion engaging with each other.

11. A connector comprising:

a connector main body configured to receive an object to be connected;

a plurality of contacts disposed at intervals from one another within the connector main body in the width direction thereof;

a freely rotatable press member for pressing respective contacts against the object to be connected inserted into the connector main body, so that when the press member is rotated in one direction, respective contacts are configured to be pressed toward the object to be connected by the press member and, when the press member is rotated in the other direction, the press of the respective contacts by the press member is configured to be cancelled; and a rotation fulcrum of the press member is provided between one and the other ends thereof, so that when one end of the press member is pressed, the press member is configured to rotate in one direction and, when the other end of the press member is pressed, the press member is configured to rotate in the other direction, wherein the press member is adapted so that the rotation fulcrum thereof shifts from a first rotation fulcrum to a second rotation fulcrum in the course of the press member being rotated to one rotational position, and the second rotation fulcrum is provided in a position where a pressing force exerted upon the respective contacts by the press member is greater than in the position of the first rotation fulcrum, and the contacts are provided with an engagement portion with which the press member rotatably engages, the engagement portion includes a first convex portion and a first concave portion provided in the contacts and a second concave portion and a second convex portion provided in the press member, so that the press member rotates with a contacting portion of the first convex portion and the second concave portion as the first rotation fulcrum as the result of the first convex portion and the second concave portion engaging with each other, and that the press member rotates with a contacting portion of the first concave portion and the second convex portion as the second rotation fulcrum as the result of the first concave portion and the second convex portion engaging with each other.

12. The connector according to claim 11, wherein the contacts are provided with first and second abutting portions against which the press member abuts, and the press member and the contacts are adapted so that the abutting position of the press member shifts from the first abutting portion to the second abutting portion in the course of the press member being rotated to one rotational position, the first abutting portion being formed so that the contacts are displaced by the abutment of the press member, the second abutting portion being formed so that the contacts are kept displaced by the abutment of the press member.

13. The connector according to claim 11, wherein the contacts are provided with an engagement portion with which the press member rotatably engages.

14. The connector according to claim 11, wherein the rotation fulcrum comprises at least one of a concave portion of the press member configured to engage with a convex portion of a fixing piece, or a convex portion of the press member configured to engage with a concave portion of the fixing piece.

* * * * *